US007640937B1

(12) United States Patent
Scott

(10) Patent No.: US 7,640,937 B1
(45) Date of Patent: Jan. 5, 2010

(54) ARTIFICIAL NAIL REMOVAL CONTAINER

(76) Inventor: Alfreda S. Scott, 9325 Birwood Rd., Detroit, MI (US) 48204

( * ) Notice: Subject to any disclaimer, the term of this patent is extended or adjusted under 35 U.S.C. 154(b) by 539 days.

(21) Appl. No.: 11/409,221

(22) Filed: Apr. 24, 2006

(51) Int. Cl.
*A45D 29/18* (2006.01)
*A45D 29/20* (2006.01)

(52) U.S. Cl. ..... 132/74.5; 132/75

(58) Field of Classification Search ..... 132/74.5, 132/75, 73.5, 73; 15/227
See application file for complete search history.

(56) References Cited

U.S. PATENT DOCUMENTS 2,670,473 A * 3/1954 Stebic ..... 2/159
2,790,982 A * 5/1957 Schneider ..... 401/7
3,124,825 A * 3/1964 Iovenko ..... 15/104.93
3,128,472 A * 4/1964 Kinney ..... 2/159
3,608,566 A * 9/1971 Storandt ..... 132/312
4,938,347 A * 7/1990 Tillman ..... 206/209
4,964,188 A * 10/1990 Olson ..... 15/227
5,054,503 A 10/1991 Keller
5,065,778 A 11/1991 Terrell
5,388,597 A 2/1995 Smith et al.
5,806,536 A 9/1998 Tietjen
5,823,203 A 10/1998 Carroll et al.
6,189,150 B1 * 2/2001 Jones-Roberson ..... 2/163
6,290,418 B1 * 9/2001 Frey ..... 401/126
D453,295 S 2/2002 Bell et al.
D453,965 S * 2/2002 Husain ..... D24/140
6,634,367 B2 * 10/2003 Abraham et al. ..... 132/74.5
2004/0025896 A1 2/2004 Tsukamoto
2005/0082197 A1 * 4/2005 Carol et al. ..... 206/575

* cited by examiner

*Primary Examiner*—Robyn Doan

(57) ABSTRACT

An artificial nail removal container for containing a solvent to loosen artificial nails from a hand includes a bag receiving a solvent and a hand with artificial nails thereon to allow the artificial nails to soak in the solvent and loosen the artificial nails from the hand. The bag includes a peripheral wall defining an interior space of the bag. The interior space receives the solvent and the hand. Each of a pair of complimentary fasteners is coupled to an interior surface of the peripheral wall. One of the complimentary fasteners is complimentary to the other one of the complimentary fasteners to selectively close the bag. A constriction band is coupled to the peripheral wall and positioned adjacent to the complimentary fasteners. The constriction band constricts around a wrist to inhibit odors from the solvent exiting the interior space when the hand is positioned in the interior space.

7 Claims, 3 Drawing Sheets

ARTIFICIAL NAIL REMOVAL CONTAINER

BACKGROUND OF THE INVENTION

1. Field of the Invention

The present invention relates to nail polish removal devices and more particularly pertains to a new nail polish removal device for containing a solvent to loosen artificial nail from a hand.

2. Description of the Prior Art

The use of nail polish removal devices is known in the prior art. The prior art commonly teaches the use of rigid container with an absorbent material that receives a solvent and is used to dissolve nail polish or loosen artificial nails.

While these devices fulfill their respective, particular objectives and requirements, the need remains for a device that has certain improved features that allows for all artificial nails on a hand to be soaked at the same time thus reducing the amount of time to remove the artificial nails from the hand. Additionally, the device constricts around the wrist to inhibit odors from a solvent leaking out of the device while the artificial nails are being soaked in the solvent.

SUMMARY OF THE INVENTION

The present invention meets the needs presented above by generally comprising a bag receiving a solvent and a hand with artificial nails thereon to allow the artificial nails to soak in the solvent and loosen the artificial nails from the hand. The bag includes a peripheral wall defining an interior space of the bag. The interior space receives the solvent and the hand. Each of a pair of complimentary fasteners is coupled to an interior surface of the peripheral wall. One of the complimentary fasteners is complimentary to the other one of the complimentary fasteners to selectively close the bag. A constriction band is coupled to the peripheral wall and positioned adjacent to the complimentary fasteners. The constriction band constricts around a wrist to inhibit odors from the solvent exiting the interior space when the hand is positioned in the interior space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
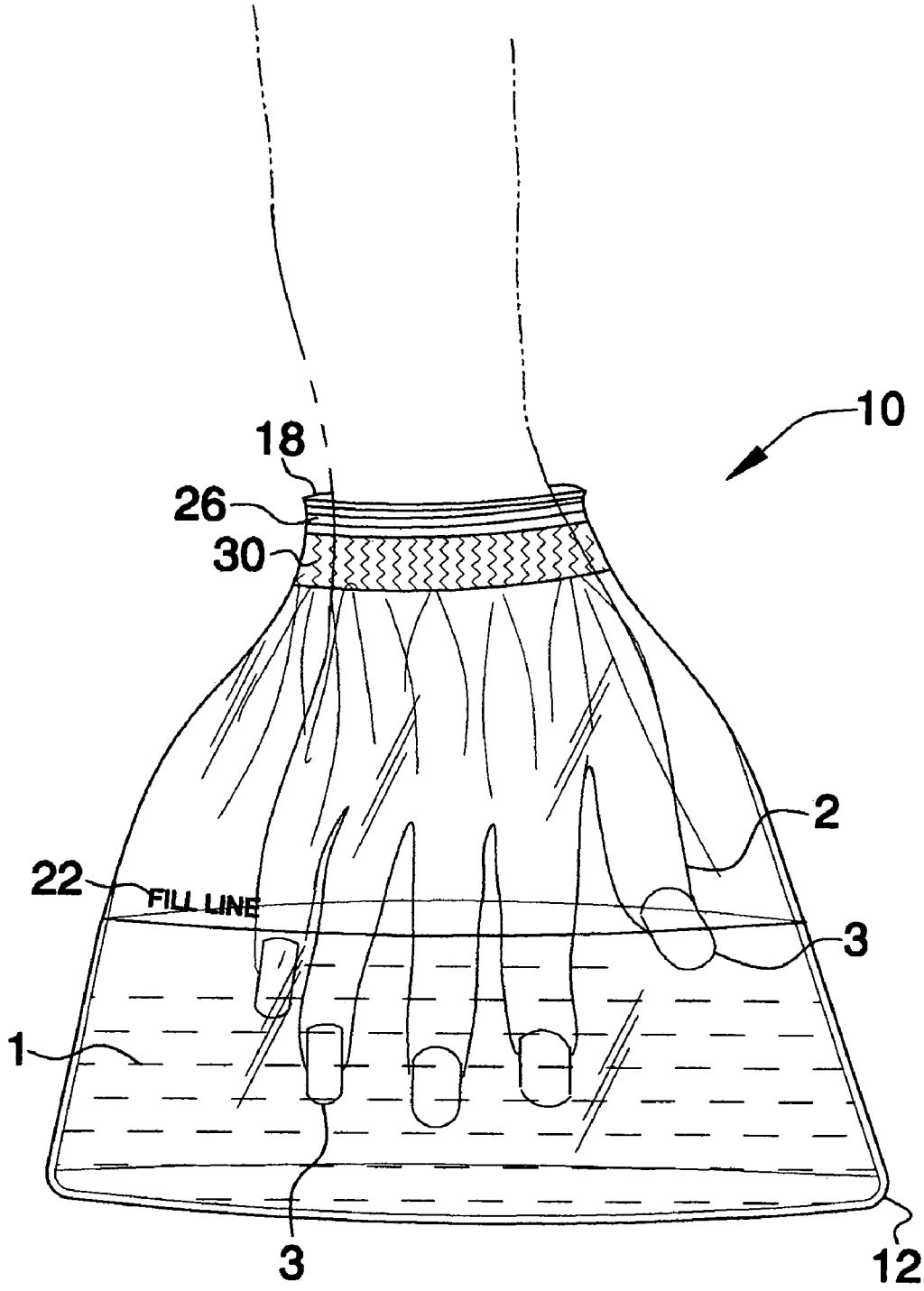
FIG. 1 is a front view of an artificial nail removal container according to the present invention shown in use.
Figure 2:
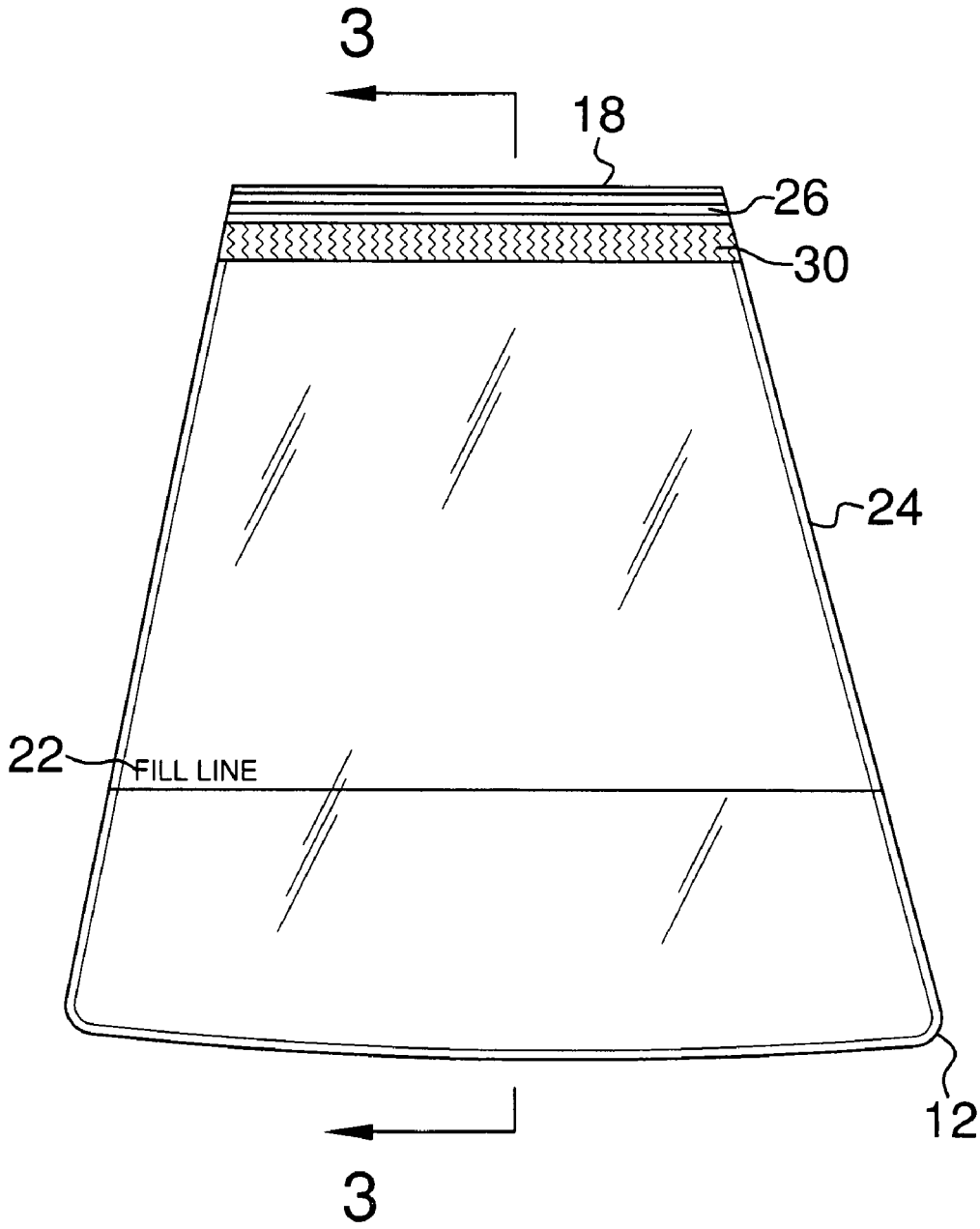
FIG. 2 is a front view of the present invention.
Figure 3:
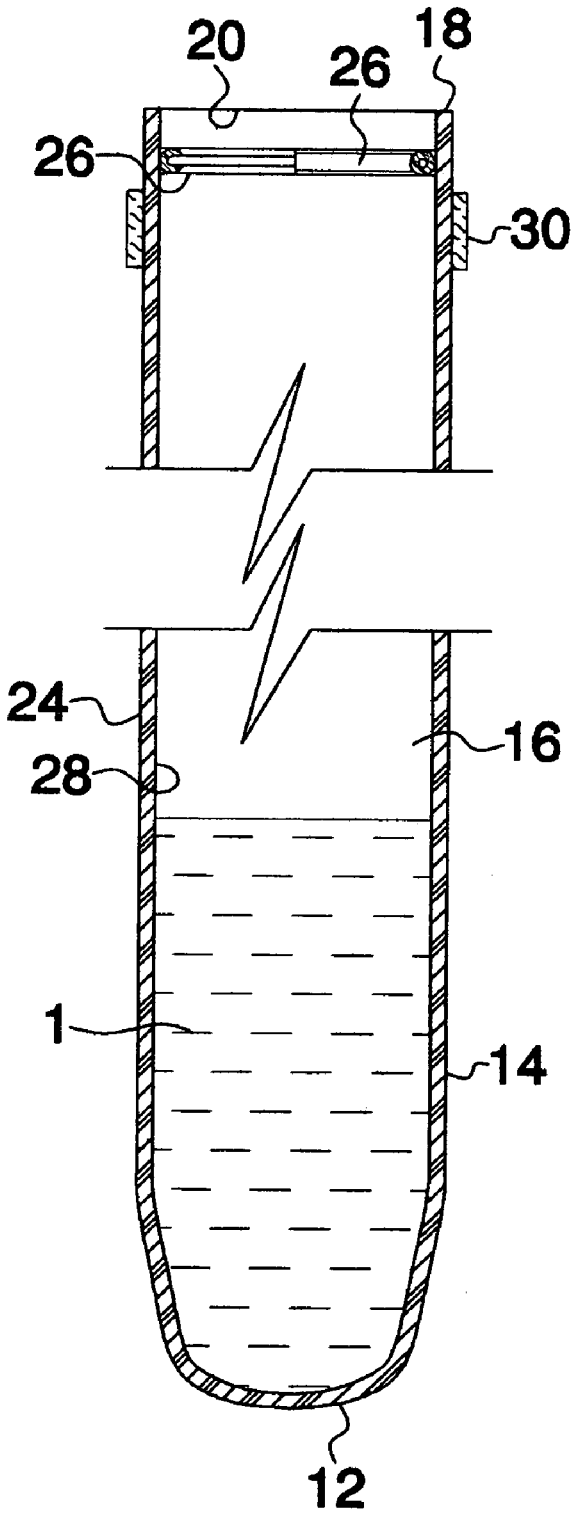
FIG. 3 is a cross-sectional view of the present invention taken along line 3-3 of FIG. 2.

With reference now to the drawings, and in particular to FIGS. 1 through 3 thereof, a new nail polish removal device embodying the principles and concepts of the present invention and generally designated by the reference numeral 10 will be described.

As best illustrated in FIGS. 1 through 3, the artificial nail removal container 10 generally comprises a bag 12 receiving a solvent 1 and a hand 2 with artificial nails 3 thereon to allow the artificial nails 3 to soak in the solvent 1 and loosen the artificial nails 3 from the hand 2. The bag 12 includes a peripheral wall 14 defining an interior space 16 of the bag 12. The interior space 16 receives the solvent 1 and the hand 2. A top edge 18 of the peripheral wall 14 defines an upper open end 20 to permit the hand 2 and the solvent 1 to be placed in the interior space 16. The bag 12 has fill indicia 22 positioned on an exterior surface 24 of the peripheral wall 14 to indicate a level to which the interior space 16 is to be filled with the solvent 1. The bag 12 is comprised of transparent material to permit viewing of the hand 2 and the solvent 1 in the bag 12. The transparent material is flexible and impermeable to the solvent 1.

Each of a pair of complimentary fasteners 26 is coupled to an interior surface 28 of the peripheral wall 14 adjacent the top edge 18 of the peripheral wall 14. One of the complimentary fasteners 26 is positioned opposite the other one of the complimentary fasteners 26. One of the complimentary fasteners 26 is complimentary to the other one of the complimentary fasteners 26 to selectively close the upper open end 20 and inhibit leakage of the solvent 1 from the interior space 16. The complimentary fasteners 26 are separable to permit opening of the upper open end 20 and gain access to the interior space 16.

A constriction band 30 is coupled to the peripheral wall 14 and positioned adjacent to the complimentary fasteners 26. The constriction band 30 extends around a circumference of the peripheral wall 14. The constriction band 30 constricts around a wrist to inhibit odors from the solvent 1 exiting the interior space 16 when the hand 2 is positioned in the interior space 16. The constriction is comprised of an elastomeric material to permit a diameter of the constriction band 30 to change to accommodate hands 2 and wrists of various sizes.

In use, the solvent 1 is poured into the interior space 16 of the bag 12 to the fill indicia 22. The hand 2 is then placed into the interior space 16 with the artificial nails 3 positioned in the solvent 1. The constriction band 30 constricts around the wrist to inhibit odors from the solvent 1 from escaping the bag 12. Once the solvent 1 has loosened the artificial nails 3, the hand 2 is removed from the interior space 16. The complimentary fasteners 26 are engaged to close the upper open end 20 and permit ready disposal of the bag 12 and the solvent 1 in the bag 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An artificial nail removal container to remove artificial nails, said container comprising:

a bag;

a quantity of solvent for loosening artificial nails being positioned in said bag, a hand with the artificial nails thereon being positionable in said bag to allow the artificial nails to soak in the solvent and loosen the artificial nails from the hand, said bag includes a peripheral wall defining an interior space of said bag, said interior space receiving the solvent and the hand, a pair of complimentary fasteners, each of said complimentary fasteners being coupled to an interior surface of said peripheral wall, one of said complimentary fasteners being complimentary to the other one of said complimentary fasteners to selectively close said bag; and a constriction band being coupled to said peripheral wall and positioned adjacent to said complimentary fasteners, said constriction band constricting around a wrist to inhibit odors from the solvent exiting said interior space when the hand is positioned in the interior space, said constriction band extending around a circumference of said peripheral wall and comprising of an elastomeric material to permit a diameter of said constriction band to change to accommodate hands and wrists of various sizes.

2. The container according to claim 1, wherein said peripheral wall includes a top edge defining an upper open end to permit the hand and the solvent to be placed in said interior space.

3. The container according to claim 2, wherein said complimentary fasteners are positioned adjacent said top edge of said peripheral wall.

4. The container according to claim 3, wherein one of said complimentary fasteners is positioned opposite the other one of said complimentary fasteners, one of said complimentary fasteners being complimentary to the other one of said complimentary fasteners to selectively close said upper open end and inhibit leakage of the solvent from said interior space, said complimentary fasteners being separable to permit opening of said upper open end and gain access to said interior space.

5. The container according to claim 1, wherein said bag has a fill indicia positioned on an exterior surface of said peripheral wall to indicate a level to which said interior space is to be filled with the solvent.

6. The container according to claim 1, wherein said bag is comprised of transparent material to permit viewing of the hand and the solvent in said bag, said transparent material being flexible and impermeable to the solvent.

7. An artificial nail removal container to remove artificial nails, said container comprising:

a bag;

a quantity of solvent for loosening artificial nails being positioned in said bag, a hand with the artificial nails thereon being positionable in said bag to allow the artificial nails to soak in the solvent and loosen the artificial nails from the hand, said bag includes a peripheral wall defining an interior space of said bag, said interior space receiving the solvent and the hand, a top edge of said peripheral wall defining an upper open end to permit the hand and the solvent to be placed in said interior space, said bag having a fill indicia positioned on an exterior surface of said peripheral wall to indicate a level to which said interior space is to be filled with the solvent, said bag being comprised of transparent material to permit viewing of the hand and the solvent in said bag, said transparent material being flexible and impermeable to the solvent;

a pair of complimentary fasteners, each of said complimentary fasteners being coupled to an interior surface of said peripheral wall adjacent said top edge of said peripheral wall, one of said complimentary fasteners being positioned opposite the other one of said complimentary fasteners, one of said complimentary fasteners being complimentary to the other one of said complimentary fasteners to selectively close said upper open end and inhibit leakage of the solvent from said interior space, said complimentary fasteners being separable to permit opening of said upper open end and gain access to said interior space; and a constriction band being coupled to said peripheral wall and positioned adjacent to said complimentary fasteners, said constriction band extending around a circumference of said peripheral wall, said constriction band constricting around a wrist to inhibit odors from the solvent exiting said interior space when the hand is positioned in the interior space, said constriction being comprised of an elastomeric material to permit a diameter of said constriction band to change to accommodate hands and wrists of various sizes.

* * * * *